United States Patent [19]

Ulmer

[11] Patent Number: 5,027,727

[45] Date of Patent: Jul. 2, 1991

[54] SEWING MACHINE WITH ADJUSTABLE FABRIC GUIDE

[75] Inventor: Christian Ulmer, Steckborn, Switzerland

[73] Assignee: Fritz Gegauf Aktiengesellschaft Bernina-Nähmaschinenfabrik, Steckborn, Switzerland

[21] Appl. No.: 518,916

[22] Filed: May 4, 1990

[30] Foreign Application Priority Data

May 18, 1989 [CH] Switzerland ..... 1858/89

[51] Int. Cl.[5] ..... D05B 35/12

[52] U.S. Cl. ..... 112/153; 112/136

[58] Field of Search ..... 112/136, 143, 146, 153, 112/306, 131; 83/743; 271/248; 33/755, 2 R, 757, 759, 768

[56] References Cited

U.S. PATENT DOCUMENTS

| | | | |
|---|---|---|---|
| 675,785 | 6/1901 | Moller | 112/153 |
| 1,087,216 | 2/1914 | Cooper | 112/136 |
| 1,278,296 | 9/1918 | Blood | 112/136 |
| 1,547,965 | 7/1925 | Seybert | 112/153 |
| 2,478,032 | 8/1949 | Wallsh | 112/153 |
| 2,645,194 | 7/1953 | Underwood | 112/153 |
| 3,011,461 | 12/1961 | Johnson | 112/153 |
| 3,834,030 | 9/1974 | Hanson | 33/759 |
| 4,572,090 | 2/1986 | Hanyu et al. . | |
| 4,908,543 | 3/1990 | Johnson | 33/768 |

*Primary Examiner*—Werner H. Schroeder
*Assistant Examiner*—Sullivan C. Prak
*Attorney, Agent, or Firm*—Peter K. Kontler

[57] ABSTRACT

A sewing machine wherein the fabric supporting arm or bed carries a fabric guide which is movable to any one of a number of positions at different distances from the needle. The fabric guide carries a tape measure or the arm or bed carries a ruler. The tape measure or the ruler has an eyelet for temporary attachment of the tape measure or of the ruler to the needle. The fabric guide is movable along the tape measure or ruler to a position at a desired distance from the needle. The eyelet is then detached from the needle and the tape measure or the ruler is retracted, either by hand or by a spring, to be out of the way during sewing. At such time, one edge of the fabric abuts a stop of the fabric guide while the needle makes a row of stitches at the selected distance from the edge.

15 Claims, 2 Drawing Sheets

SEWING MACHINE WITH ADJUSTABLE FABRIC GUIDE

BACKGROUND OF THE INVENTION

The invention relates to sewing machines in general, and more particularly to improvements in sewing machines with fabric guides. Still more particularly, the invention relates to improvements in sewing machines with adjustable fabric guides.

The making of a row of stitches at a desired distance from the edge of a fabric which is being treated in a sewing machine necessitates the utilization of a fabric guide. U.S. Pat. No. 4,572,090 to Hanyu et al. discloses an adjustable fabric guide in the form of an inverted U-shaped yoke which can be held on the leg of a sewing machine by friction and can be shifted by hand to position its fabric stop at a selected distance from the needle. If an operator of the sewing machine desires to move the stop of the shiftable fabric guide to a position at a selected distance from the needle, such operator is compelled to guess and make a coarse adjustment, use a ruler to measure the distance of the stop from the needle, and thereupon make at least one additional adjustment if the initially selected distance is unsatisfactory. This is a time-consuming operation which is rendered more difficult if the yoke is held in engagement with the arm exclusively by friction, i.e., if the frictional engagement between the yoke and the arm must suffice to prevent accidental shifting of the yoke while the sewing machine is in actual use and the edge of a piece of fabric which is being treated abuts the stop. The measurement is particularly difficult if the stop is to be located at a relatively short or very short distance from the needle.

OBJECTS OF THE INVENTION

An object of the invention is to provide a novel and improved fabric guide which can be properly positioned within a fraction of the time that is required to carry out such operation in accordance with heretofore known proposals.

Another object of the invention is to provide a sewing machine which embodies the above outlined fabric guide.

A further object of the invention is to provide a fabric guide which can be moved to a position at a desired distance from the needle without the need for repeated utilization of discrete standard rulers or other measuring devices.

An additional object of the invention is to provide a sewing machine wherein the needle can be used as one component of the means for facilitating accurate selection of the distance of the stop of a fabric guide from the needle.

Still another object of the invention is to provide a fabric guide which can be installed in existing sewing machines as a superior substitute for heretofore known fabric guides.

A further object of the invention is to provide a fabric guide which can be repeatedly moved to one and the same selected position with a maximum degree of reproducibility and with little loss in time.

SUMMARY OF THE INVENTION

The invention is embodied in a sewing machine which comprises a fabric supporting member (such as an elongated substantially horizontal arm), a needle which is adjacent the supporting member, a fabric guide member which is mounted on the supporting member for movement between a plurality of positions at different distances from the needle, and a rigid or flexible measuring device which is movably mounted on one of the two members to indicate the selected distance of the guide members from the needle. The guide member can include a fabric stop, and the measuring device is then operative to indicate the distance of the fabric stop from the needle. The fabric stop can include two spaced-apart sections having fabric arresting surfaces disposed in a common plane. The sections define a clearance or gap, and the measuring device is movable at the clearance substantially at right angles to the common plane of the two arresting surfaces.

The measuring device can comprise a rigid or substantially rigid ruler. Alternatively, the measuring device can comprise a tape measure and a housing for the tape measure. The housing can be provided on (e.g., it can form an integral or detachable part of) the guide member. The tape measure indicates the selected distance of the fabric stop from the needle; to this end, the fabric stop is disposed between the housing for the tape measure and the needle.

Irrespective of whether the measuring device is or comprises a ruler or a tape measure, it can include an elongated graduated or calibrated portion and a handle (e.g., an eyelet) at one end of the graduated portion. The handle is preferably provided on the graduated portion between the stop and the needle. Such handle can be provided with an opening for the needle and the guide member is movable relative to the graduated portion so that, when the needle is caused to extend through the opening of the handle and the guide member is moved along the supporting member relative to the graduated portion, the graduated portion automatically indicates the momentary distance of the guide member (particularly of the stop) from the needle. The guide member is movable to a position at a minimum distance from the needle and its fabric stop is preferably adjacent the graduated portion of the measuring device. The distance of the stop from the handle—while the needle is caused to extend through the opening of the handle—is indicative of the distance of the guide member from the needle. Thus, the stop can be said to constitute a movable marker of or for the measuring device.

The guide member can comprise a substantially plate-like base or web and the fabric stop extends upwardly from the base. The base can be provided with a recess (e.g., with an elongated groove) for the measuring device, and such recess is disposed between the two sections of the stop.

The base of the guide member overlies the arm of the supporting member, and the guide member can further comprise two legs which depend from the base and flank the arm. The measuring device is disposed at the base.

The novel features which are considered as characteristic of the invention are set forth in particular in the appended claims. The improved sewing machine itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
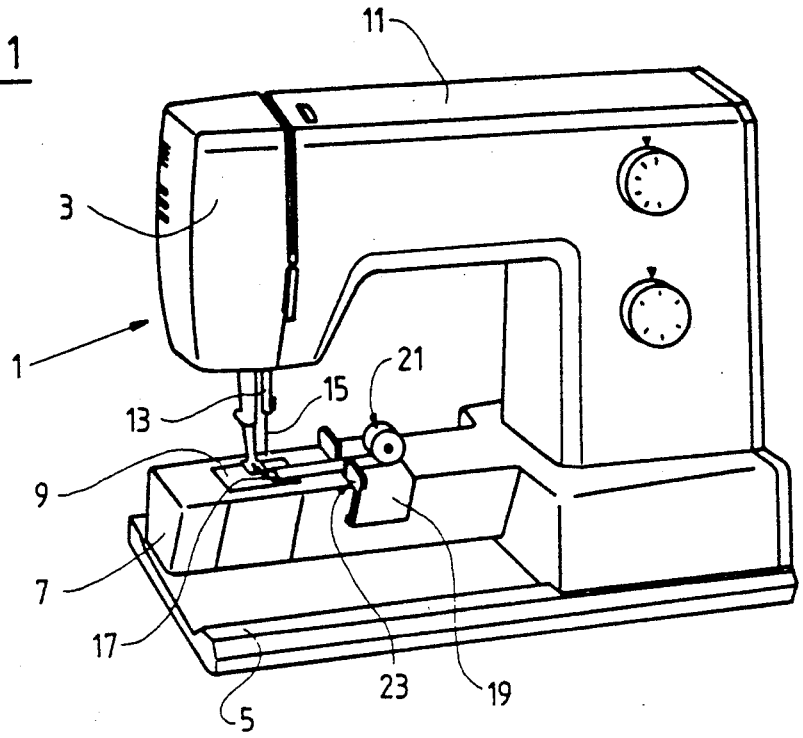
FIG. 1 is a somewhat schematic perspective view of a sewing machine with an adjustable fabric guide which is constructed and mounted in accordance with a first embodiment of the invention.

FIG. 1 shows a sewing machine 1 which can be of the type known as Bernina 801 or 802 or 803 Sport or Bernina Record 930, 931, 932 or 933 or Bernina Matic 910 (all manufactured and distributed by the assignee of the present application). The illustrated sewing machine 1 comprises a base plate 5 for a fabric supporting member in the form of a free arm 7 and a overhead housing 3 including an L-shaped section 11 which has an upright part carrying the controls and a horizontal part supporting a needle bar 13 and a presser foot. The needle 15 in the bar 13 is movable up above and down into a hole 17 in a plate 9 which is provided in or on the free arm 7.

The improved fabric guide member 19 (hereinafter called fabric guide for short) is an inverted U-shaped body having a base or web 50 which overlies the upper side of the arm 7 and two legs 41 which flank the arm and have inwardly extending lower marginal portions 43 (see FIG. 3) serving to bear against the adjacent sides of the arm in order to maintain the fabric guide 19 in a selected position, namely in a position at a selected distance a from the needle 15. The fabric guide 19 can be made of an elastomeric plastic material which permits at least some flexing of the base or web 50 so as to enable the operator to rapidly slip the fabric guide onto or to rapidly detach the fabric guide from the arm 7 subsequent to increasing the distance of the marginal portions 43 from each other.

When the operator decides to change the distance of a twin-section stop 23 at the front end of the fabric guide 19 from the needle 15, the web 50 and/or the legs 41 are simply pushed in the desired direction longitudinally of the arm 7 until the stop 23 reaches a position at the desired distance a from the needle.

In accordance with a feature of the invention, the fabric guide 19 is associated with a distance measuring device 21 including a flexible tape measure 39 and a housing 29 for the tape measure. The housing 29 is permanently or detachably secured to the base 50 of the fabric guide 19. For example, and especially if the fabric guide 19 is made of a plastic material, the housing 29 can constitute an integral part of the base 50.

The stop 23 comprises two mirror symmetrical sections 25 which define a clearance 27 and have coplanar front sides or surfaces confronting the needle 15. The exposed end portion of the tape measure 39 extends through the clearance 27 between the sections 25 of the stop 23 and carries a handle in the form of a ring or eyelet 33 which can receive the needle 15. The width of the clearance 27 is or can be selected in such a way that the handle 33 cannot extend therethrough. This prevents a customary winding or convoluting spring (not shown) in the housing 29 from retracting the entire tape measure 39 into the housing.

Figure 2:
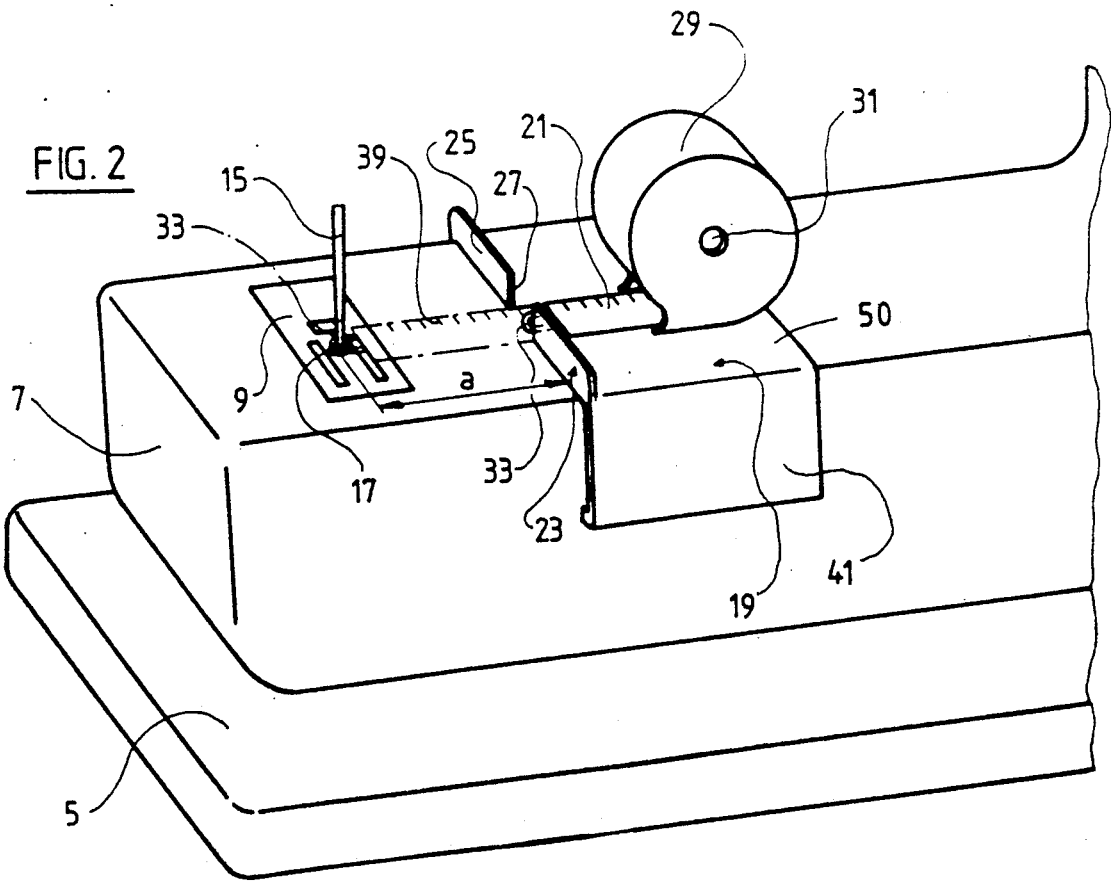
FIG. 2 is an enlarged perspective view of a detail in the sewing machine in FIG. 1, showing the fabric guide at a selected distance from the needle.

FIG. 2 shows that the tape measure 39 can be extracted from the housing 29 at a selected distance of the stop 23 from the needle 15 preparatory to introduction of the needle into the handle 33 (or preparatory to slipping of the handle 33 onto the needle while the needle is maintained in a raised position above the plate 9). The operator then simply reads that graduation at the upper side of the tape measure 39 which is pinpointed by the sections 25 of the stop 23, and such graduation is indicative of the distance a of the front sides or surfaces of the stop sections 25 from the needle 15. If the distance a is excessive or too short, the operator slides the fabric guide 19 and the housing 29 thereon toward or away from the needle 15 until the stop 23 comes to register with the desired graduation. Thus, the stop 23 can be said to constitute a marker of or for the measuring device 21 including the tape measure 39.

When the needle 15 extends into the handle 33 and the latter abuts the stop 23, the fabric guide 19 is located at a minimum (zero) distance from the needle. Thus, if the needle is thereupon caused to make a row of stitches in a fabric one edge of which abuts the coplanar surfaces of the stop sections 25, such row of stitches is formed at a minimum distance from the edge.

In order to ensure more satisfactory guidance of the tape measure 39 during movement into or during extraction from the housing 29, the web or base 50 of the fabric guide 19 is preferably provided with a recess in the form of an elongated groove 35 extending at right angles to the common plane of front surfaces of the stop sections 25.

The scale at the upper side of the tape measure 39 can be imprinted onto or etched or otherwise formed in the material of the tape measure. Such scale can indicate the distance in centimeters and fractions of centimeters and/or inches and fractions of inches. The spring in the housing 29 invariably tends to convolute the tape measure 39 onto a core 31 in the housing 29 and to thus maintain the handle 33 in abutment with the coplanar surfaces of the stop sections 25. Friction between the fabric guide 19 and the free arm 7 is greater than the bias of the spring in the housing 29 so that the spring cannot shift the fabric guide along the arm 7 when the handle 33 receives the needle 15 and such handle is spaced apart from the stop 23. FIG. 2 shows that the handle 33 is located at a selected distance a from the stop 23 while the needle 15 extends through the handle and the legs 41 of the fabric guide 19 are in frictional engagement with the respective sides of the arm 7. The spring in the housing 29 maintains the tape measure 39 in tensioned condition so that the stop 23 invariably pinpoints that graduation on the tape measure 39 which is indicative of actual distance (a) of the stop 23 from the needle 15. Those parts of stop sections 25 which are immediately adjacent the clearance 27 are preferably thin so that they can accurately pinpoint that graduation which denotes the momentary distance of the stop 23 from the needle 15.

Figure 3:
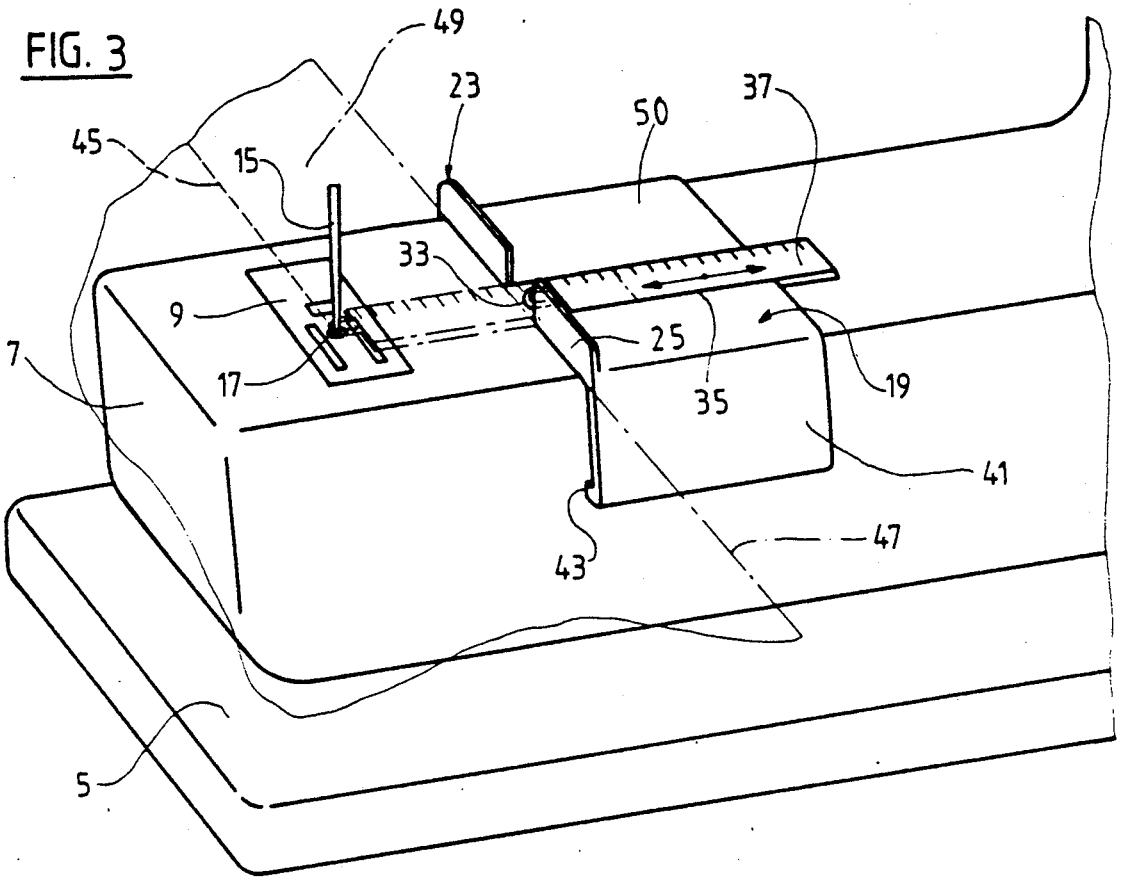
FIG. 3 is a similar perspective view of a sewing machine which is equipped with a modified fabric guide.
Figure 4:
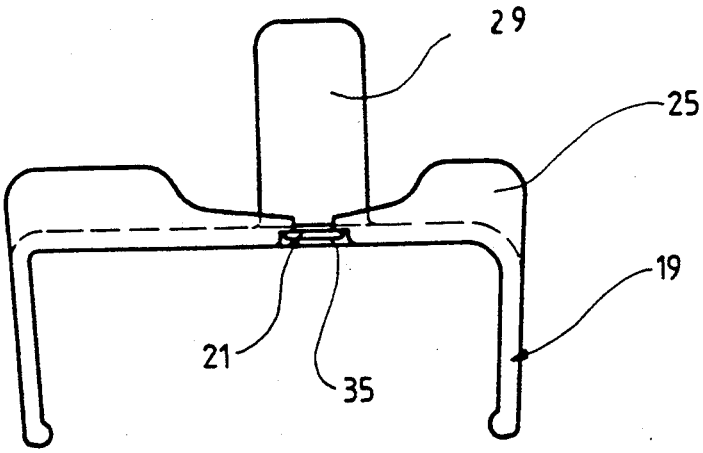
FIG. 4 is a front elevational view of the fabric guide which is used in the sewing machine of FIGS. 1 and 2.

FIG. 3 shows a portion of a modified sewing machine wherein all such parts which are identical with or clearly analogous to corresponding parts of the sewing machine 1 of FIGS. 1 and 2 are denoted by similar reference characters. The main difference between the two illustrated embodiments of the sewing machine is that the measuring device of FIG. 3 comprises a straight rigid or at least partly rigid ruler 37 having an upper side provided with graduations and being reciprocable in the aforementioned recess or groove 35 in the upper side of the web or base 50. The arm 7 is connected with a spring (not shown) which permanently biases the ruler 37 in a single direction, namely away from the needle 15. The left-hand end portion of the ruler 37 carries a handle 33 in the form of an eyelet or ring which cannot pass through the clearance between the sections 25 of the stop 23 and can receive the tip of the needle 15. The graduation which then registers with the adjacent parts of sections 25 is indicative of the momentary distance of the stop 23 from the needle 15. Save for the absence of a housing 29 thereon, the fabric guide 19 of FIG. 3 is or can be identical with the fabric guide of FIGS. 1, 2 and 4.

FIG. 3 shows by phantom lines a piece of fabric 49 which overlies the free end portion of the arm 7 beneath the lifted needle 15. The edge 47 of the fabric 49 abuts the adjacent coplanar surfaces of stop sections 25 and the needle 15 serves to make a row 45 of stitches at a selected distance from the edge 47, namely at a distance which is pointed out by stop sections 25 on the scale including graduations at the upper side of the ruler 37.

An advantage of the sewing machine of FIG. 3 is that friction between the fabric guide 19 and the arm 7 can be less than that between the fabric guide and the arm of FIGS. 1 and 2 because the spring which tends to move the ruler 37 away from the needle 15 (against a suitable abutment at the rear end of the recess or groove 35) does not or need not act upon the fabric guide since the ruler 37 is not or need not be coupled to the fabric guide.

The improved fabric guide and distance measuring device can be used with equal advantage in other types of sewing machines, e.g., in flat-bed machines of the type known as Bernina 811 Sport. The bed then constitutes a supporting member for the distance measuring device and/or for the fabric guide, depending upon whether the measuring device is mounted on the fabric guide or directly on the supporting member.

If the fabric guide 19 is normally detached from the bed or from the arm 7, slipping of the handle 33 of the tape measure 39 or ruler 37 onto the needle 15 can precede the attachment of fabric guide to the arm or bed. The fabric guide 19 is thereupon attached to the arm or bed and is moved (if necessary) toward or away from the needle until the sections 25 of the stop 23 pinpoint that graduation which is indicative of the desired or optimum distance of the edge 47 from the needle 15.

It is equally possible to employ the illustrated fabric guide 19, or a discrete second fabric guide, on the arm 7 or on the bed of a flatbed sewing machine to the left of the needle 15 (as seen in FIGS. 1–2 or in FIG. 3); the thus mounted fabric guide then maintains the left-hand edge of a piece of fabric at a selected distance from the row of stitches which are formed by the needle 15. It is even possible to mount the fabric guide or a fabric guide and the distance measuring device on a supporting member in the form of a table which is placed next to the arm 7 or next to the bed if such table is needed in order to provide adequate support for a large piece of fabric. It is then merely necessary to provide the fabric guide with suitable means for preferably frictionally engaging the table with freedom of movement toward and away from the needle.

It is clear that, once the fabric guide 19 is moved to a selected position relative to the needle 15, the handle 33 is detached from the needle and is preferably automatically returned to its starting or zero position of abutment with the stop 23, either by the spring in the housing 29 for the tape measure 39 or by the spring which biases the ruler 37 to a retracted position. The spring which biases the ruler 37 to retracted position constitutes an optional feature, i.e., the ruler can be retracted by hand as soon as it has served the purpose of facilitating positioning of the stop 23 at a desired distance from the needle 15.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A sewing machine comprising a fabric supporting member; a needle adjacent said fabric supporting member; a fabric guide member mounted on said fabric supporting member for movement between a plurality of positions at different distances from said needle; and a distance measuring device movably mounted on one of said members to indicate the selected distance of said fabric guide member from said needle.

2. The sewing machine of claim 1, wherein said fabric guide member has a fabric stop and said distance measuring device is movable to indicate the selected distance of said fabric stop from said needle.

3. The sewing machine of claim 2, wherein said stop includes two sections having fabric arresting surfaces disposed in a common plane, said sections defining a clearance and said distance measuring device being movable at said clearance substantially at right angles to said common plane.

4. The sewing machine of claim 1, wherein said distance measuring device comprises a ruler.

5. The sewing machine of claim 1, wherein said distance measuring device comprises a tape measure.

6. The sewing machine of claim 5, wherein said distance measuring device further comprises a housing for said tape measure, said housing being provided on said fabric guide member.

7. The sewing machine of claim 6, wherein said fabric guide member comprises a fabric stop and said tape measure is designed to indicate the selected distance of said fabric stop from said needle, said fabric stop being disposed between said housing and said needle.

8. The sewing machine of claim 1, wherein said distance measuring device includes an elongated graduated portion and a handle at one end of said graduated portion.

9. The sewing machine of claim 8, wherein said fabric guide member has a fabric stop defining a clearance for said graduated portion, said handle being provided on said graduated portion between said fabric stop and said needle.

10. The sewing machine of claim 8, wherein said handle has an opening for said needle and said fabric guide member is movable relative to and along said graduated portion so that, when the needle extends through said opening and the fabric guide member is moved along said fabric supporting member relative to said graduated portion, said graduated portion automatically indicates the momentary distance of the fabric guide member from the needle.

11. The sewing machine of claim 10, wherein said fabric guide member is movable to and from a position at a minimum distance from said needle, said fabric guide member having a fabric stop adjacent said graduated portion, the distance of said fabric stop from said handle—while the needle extends through said opening—being indicative of the distance of said fabric guide member from said needle.

12. The sewing machine of claim 11, wherein said fabric stop is a movable marker of said distance measuring device.

13. The sewing machine of claim 1, wherein said fabric guide member comprises a substantially plate like base and a fabric stop extending upwardly from said base and including two spaced-apart sections, said base having a recess for said distance measuring device and said recess being disposed between said spaced-apart sections.

14. The sewing machine of claim 1, wherein said fabric guide member has an elongated guide groove for said distance measuring device.

15. The sewing machine of claim 1, wherein said fabric supporting member includes an elongated arm and said fabric guide member includes a base which overlies said arm and two legs which depend from said base and flank said arm, said distance measuring device being disposed at said base.

* * * * *